US010697729B2

(12) United States Patent
Jezwinski

(10) Patent No.: US 10,697,729 B2
(45) Date of Patent: Jun. 30, 2020

(54) BOW RELEASE DEVICE AND METHOD

(71) Applicant: Ryan L. Jezwinski, Oshkosh, WI (US)

(72) Inventor: Ryan L. Jezwinski, Oshkosh, WI (US)

( * ) Notice: Subject to any disclaimer, the term of this patent is extended or adjusted under 35 U.S.C. 154(b) by 0 days.

(21) Appl. No.: 16/501,879

(22) Filed: Jun. 21, 2019

(65) Prior Publication Data

US 2020/0003520 A1 Jan. 2, 2020

Related U.S. Application Data

(60) Provisional application No. 62/763,721, filed on Jun. 28, 2018.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 4,674,469 A * 6/1987 Peck ..... F41B 5/1438 124/32
4,860,720 A * 8/1989 Todd ..... F41B 5/1469 124/35.2
4,949,698 A * 8/1990 Burnham ..... F41B 5/1469 124/35.2
5,307,788 A * 5/1994 Peck ..... F41B 5/1469 124/35.2
5,370,102 A * 12/1994 Peck ..... F41B 5/1469 124/35.2
5,417,197 A * 5/1995 Bankstahl ..... F41B 5/1469 124/35.2
5,564,407 A * 10/1996 Linsmeyer ..... F41B 5/1469 124/35.2
5,582,158 A * 12/1996 Linsmeyer ..... F41B 5/1469 124/35.2
6,481,430 B1 * 11/2002 Lightcap, Jr. ..... F41B 5/1469 124/35.2

(Continued)

*Primary Examiner* — John A Ricci
(74) *Attorney, Agent, or Firm* — Timothy Stevens; Technology Law, PLLC

(57) ABSTRACT

A bow release of the type having a wrist strap, a first body and a second body, the first body comprising a bow string keeper and a trigger system for releasing a bow string held in the keeper, the second body comprising a coil spring biased plunger extending from the second body and attached to the first body, the second body attached to the wrist strap so that when the bow string of a bow is held by the bow string keeper while the bow is drawn by an archer having the wrist strap attached to the archers draw hand wrist, the archer can actuate the trigger of the trigger system to release the bow string from the bow string keeper. The improvement of the instant invention relates to the coil spring. The coil spring of the instant invention has an uncompressed length in the range of from one half inch to five inches and a spring rate in the range of from three pounds per inch to eighty pounds per inch and where the coil spring is compressed in the second body to a length in the range of from 0.15 inches to 2.5 inches. The bow release of the instant invention can be used as a back tension release or a trigger release.

12 Claims, 5 Drawing Sheets

(56) References Cited

U.S. PATENT DOCUMENTS

| | | | | |
|---|---|---|---|---|
| 6,484,710 | B1 * | 11/2002 | Summers | F41B 5/1469 124/35.2 |
| 6,925,995 | B1 * | 8/2005 | McConnell | F41B 5/1469 124/35.2 |
| RE38,833 | E * | 10/2005 | Linsmeyer | F41B 5/1469 124/35.2 |
| 6,968,836 | B1 * | 11/2005 | Kees | F41B 5/1469 124/35.2 |
| 7,712,460 | B2 | 5/2010 | Simo et al. | |
| 2003/0019488 | A1 * | 1/2003 | Eckert | F41B 5/1469 124/35.2 |
| 2006/0048762 | A1 * | 3/2006 | Mitchell | F41B 5/1469 124/35.2 |

* cited by examiner

BOW RELEASE DEVICE AND METHOD

BACKGROUND OF THE INVENTION

The instant invention is in the field of archery and more specifically relates to archery bow release devices. One type of bow release device is the trigger actuated recoil motion bow release device (see, for example, U.S. Pat. No. 7,712,460 herein fully incorporated by reference) typically comprising a wrist strap, a first body and a second body, the first body comprising a bow string keeper and a trigger system for releasing a bow string held in the keeper, the second body comprising a coil spring biased plunger extending from the second body and attached to the first body, the second body attached to the wrist strap so that when the bow string of a bow is held by the bow string keeper while the bow is drawn by an archer having the wrist strap attached to the archers draw hand wrist, the archer can actuate the trigger of the trigger system to release the bow string from the bow string keeper and impart a recoil motion to the archers wrist. Another type of bow release device is the back tension bow release wherein the bow string of a drawn bow is released when the bow is drawn sufficiently to automatically release the bow string from the device.

SUMMARY OF THE INVENTION

The instant invention is the discovery of an improved archery bow string release device. More specifically, the instant invention is an improved bow release comprising a wrist strap, a first body and a second body, the first body comprising a bow string keeper and a trigger system for releasing a bow string held in the keeper, the second body comprising a coil spring biased plunger extending from the second body and attached to the first body, the second body attached to the wrist strap so that when the bow string of a bow is held by the bow string keeper while the bow is drawn by an archer having the wrist strap attached to the archers draw hand wrist, the archer can actuate the trigger of the trigger system to release the bow string from the bow string keeper, wherein the improvement comprises the coil spring having an uncompressed length in the range of from one half inch to five inches and a spring rate in the range of from three pounds per inch to eighty pounds per inch, the coil spring compressed in the second body to a length in the range of from 0.15 inches to 2.5 inches. More preferably, the coil spring has an uncompressed length in the range of from one inch to three inches, a compressed length of about one inch and a spring rate of about twelve pounds per inch. In an embodiment adapted for a 60 pound draw weight bow, the coil spring has an uncompressed length of about three inches, a compressed length of about one inch and a spring rate of about ten pounds per inch. In an embodiment adapted for an 80 pound draw weight bow, the coil spring has an uncompressed length of about three inches, a compressed length of about one inch and a spring rate of about twelve pounds per inch. In an embodiment adapted for a 40 pound draw weight bow, the coil spring has an uncompressed length of about three inches, a compressed length of about one inch and a spring rate of about eight pounds per inch. In an embodiment adapted for a 20 pound draw weight bow, the coil spring has an uncompressed length of about three inches, a compressed length of about one inch and a spring rate of about 6 pounds per inch.

In another embodiment, the instant invention is a method for an archer to release an arrow from a bow using the improved bow release of any one of the devices of the preceding paragraph, comprising: (a) fixing the bow string of a bow to the bow string keeper while the bow is drawn by an archer having the wrist strap attached to the archers draw hand wrist while the archer draws the bow so that the archer can: (b) hold his/her trigger finger stationary adjacent the trigger of the trigger system as the bow is drawn to cause the first body to slide along his/her hand to contact the trigger with the stationary trigger finger to actuate the trigger to release an arrow from the bow as the bow as the bow is drawn as a back tension bow release; or (c) hold his/her trigger finger adjacent the trigger of the trigger system to voluntarily actuate the trigger of the trigger system after the bow is drawn to release an arrow from the bow voluntarily.

DETAILED DESCRIPTION OF THE INVENTION

Figure 1:
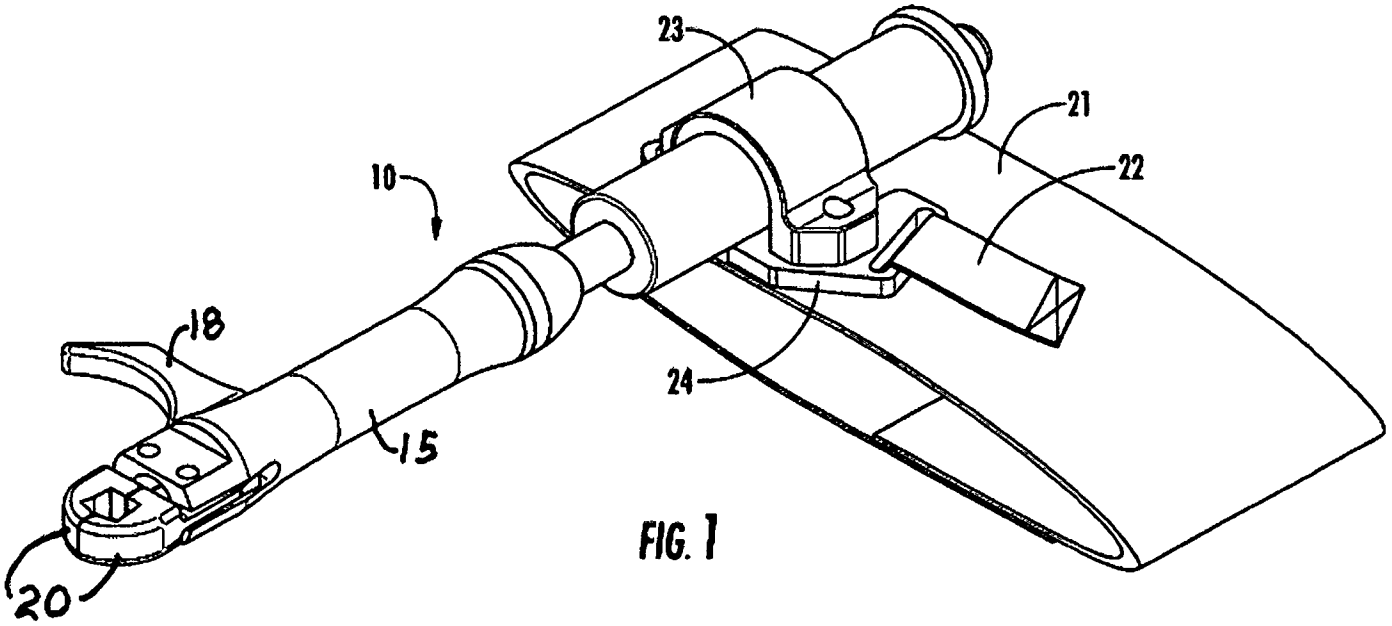
FIG. 1 is a drawing depicting a highly preferred embodiment of the instant invention.
Figure 5:
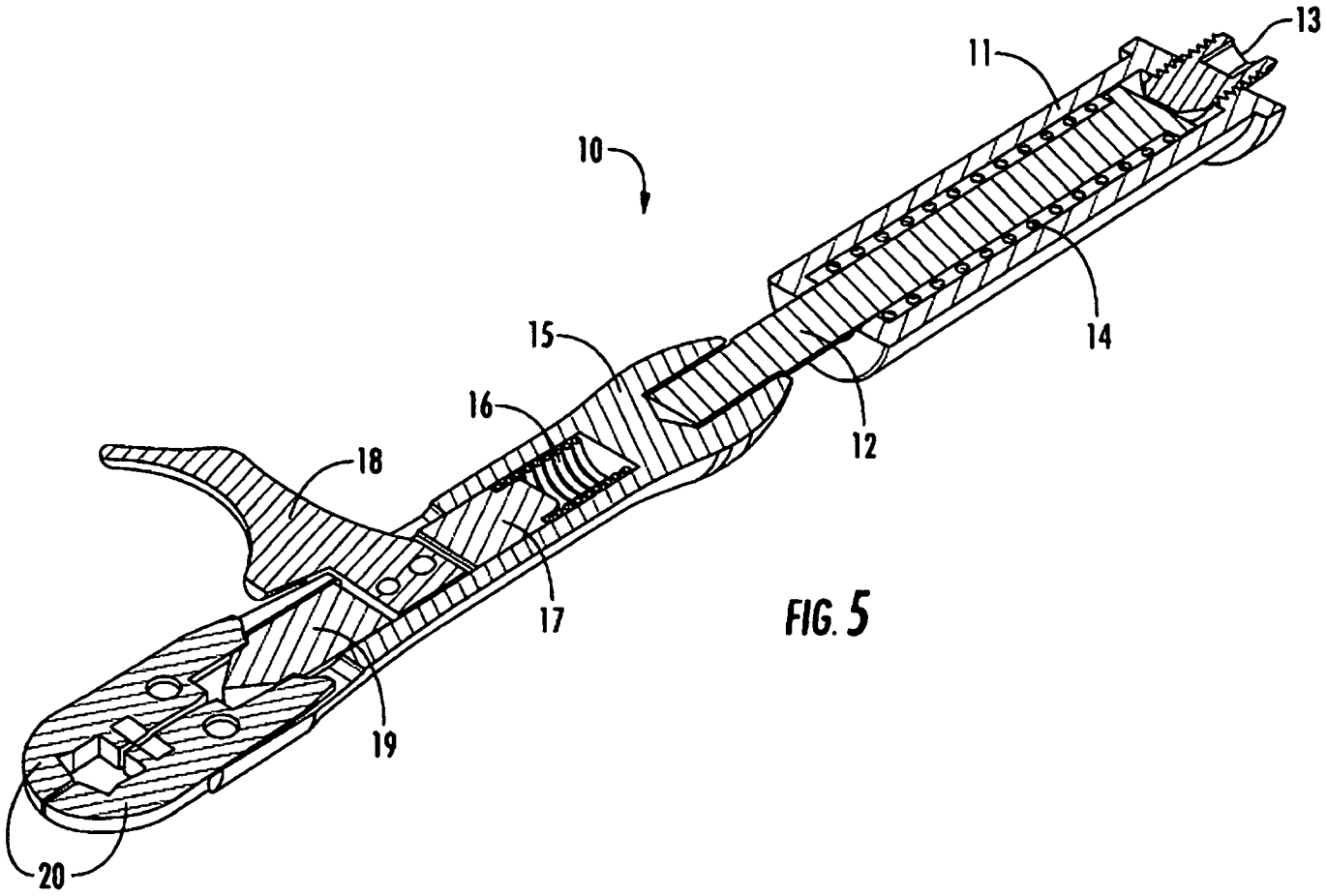
FIG. 5 is a cross-sectional drawing depicting a highly preferred back tension assembly of the instant invention.

Referring now to FIG. 1, therein is shown a highly preferred embodiment of the instant invention comprising first body 15 and second body 11 (see FIG. 5). First body 15 comprises bow string keeper 20 and trigger 18 for releasing a bow string held in keeper 20. Second body 11 comprises a coil spring biasing plunger 12 (see FIG. 5) extending from second body 11 and attached to first body 15. Second body 11 is attached to wrist strap 21 by strap 22 attached to plate 24 and bracket 23. When the bow string of a bow is held by bow string keeper 20 while the bow is drawn by an archer having the wrist strap attached to the archers draw hand wrist, the archer can actuate trigger 18 of the trigger system to release the bow string from bow string keeper 20.

Referring now to FIG. 5, therein is shown a cross-sectional drawing depicting a highly preferred back tension assembly 10 of the instant invention, comprising first body 15, bow string keeper 20, trigger system comprising trigger 18, trigger plunger 17, trigger plunger spring 16 and bow string keeper release plunger 19. Second body 11 comprises coil spring 14, coil spring biased plunger 12 and set screw 13. Coil spring 14 has an uncompressed length of three inches and a spring rate of ten pounds per inch of compression. Coil spring 14 has a compressed length of one inch which compressed length can be adjusted by screwing set screw 13 into or out of second body 11.

Referring again to FIG. 1 and to FIG. 5, in use an archer: (a) fixes the bow string of a bow to bow string keeper 20 while the bow is drawn by an archer having wrist strap 21 attached to the archers draw hand wrist while the archer draws the bow so that coil spring 14 is further compressed as the bow is drawn to cause the distance between first body 15 and second body 11 to increase so that the archer can: (b) hold his/her trigger finger stationary adjacent trigger 18 as the bow is drawn to cause first body 15 to slide along his/her hand to contact the trigger with said stationary trigger finger to actuate trigger 18 to release an arrow from the bow as the bow is drawn as a back tension arrow release; or (c) hold his/her trigger finger adjacent the trigger of the trigger system when the bow is drawn to voluntarily actuate trigger 18 to release an arrow from the bow voluntarily.

Figure 2:
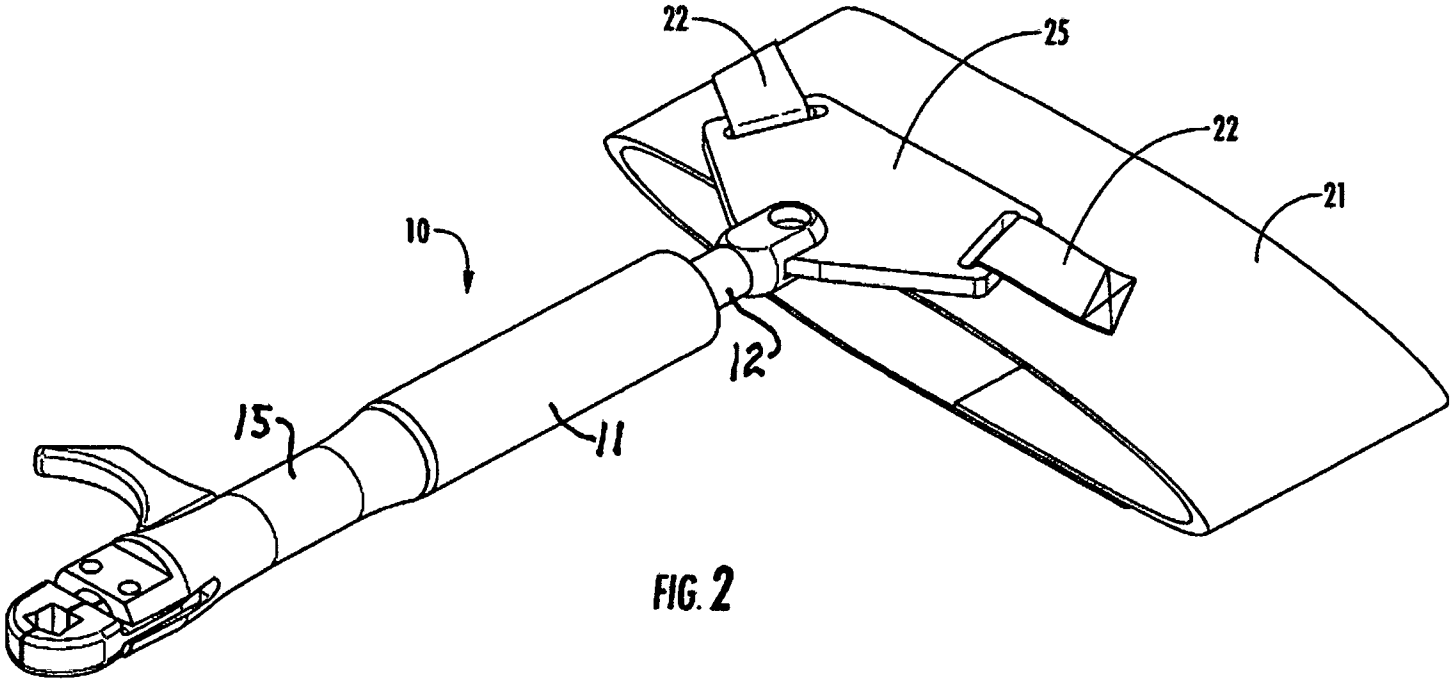
FIG. 2 is a drawing depicting another highly preferred embodiment of the instant invention.
Figure 3:
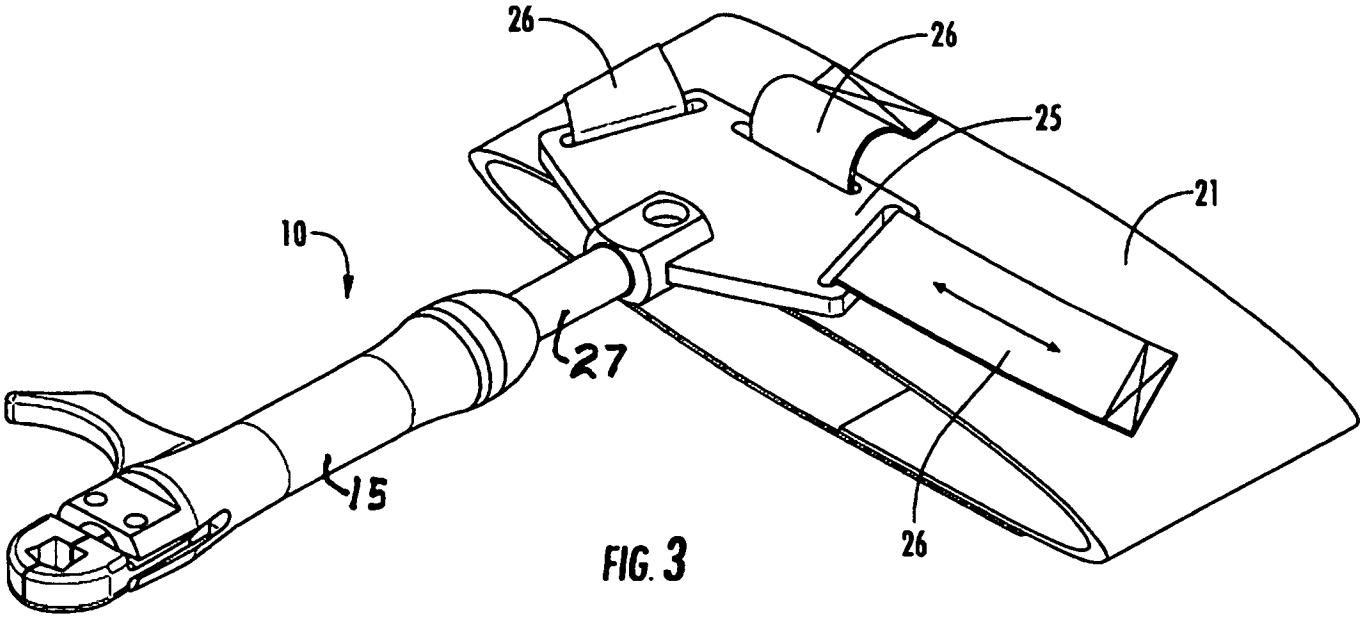
FIG. 3 is a drawing depicting yet another embodiment of the instant invention.
Figure 4:
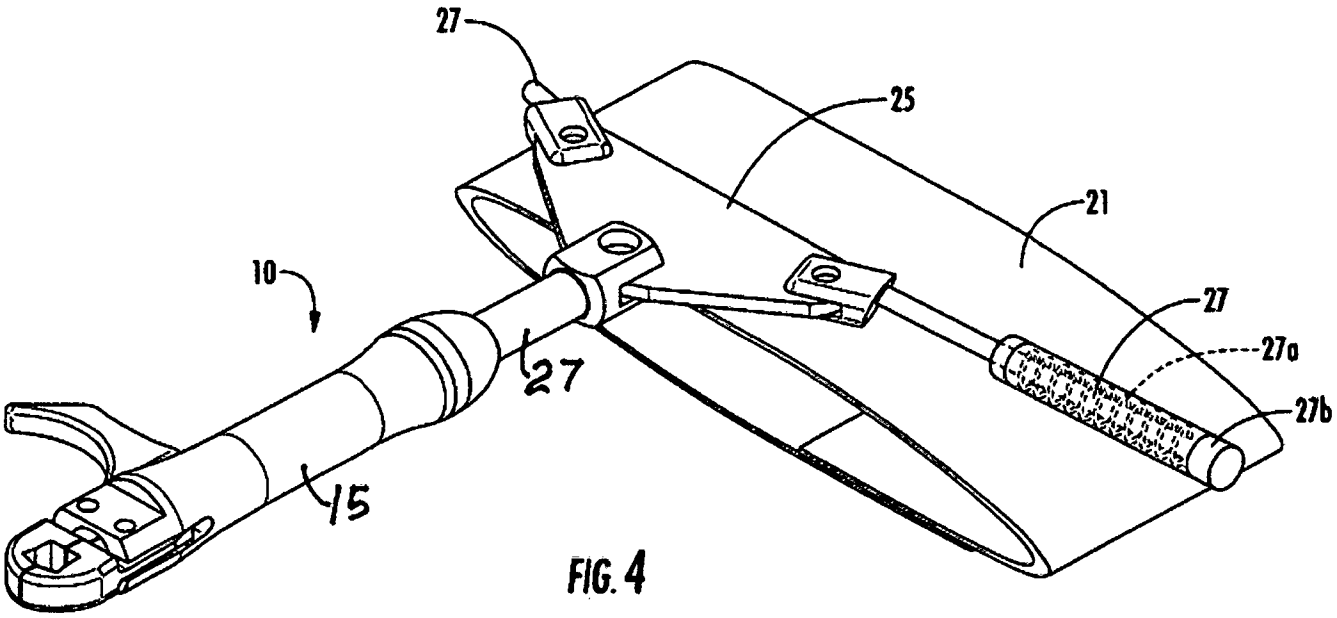
FIG. 4 is a drawing depicting still another embodiment of the instant invention.

Referring now to FIG. 2, therein is shown a drawing depicting another highly preferred embodiment of the instant invention wherein first body 11 is directly attached to second body 15 and coil spring biased plunger 12 is attached to plate 25 which is attached to wrist strap 21 by strapping 22. Referring now to FIG. 3, therein is shown a drawing depicting another highly preferred embodiment of the instant invention wherein strut 27 attaches first body 15 to plate 25 which is attached to wrist strap 21 by elastic bands 26. In this embodiment, the function of the coil spring is equivalently performed by elastic bands 26. Referring now to FIG. 4, therein is shown a drawing depicting another highly preferred embodiment of the instant invention wherein strut 27 attaches first body 15 to plate 25 which is attached to wrist strap 21 by rod 27, spring 27*a* and capsule 27*b*. In this embodiment, the function of coil spring 14 shown in FIG. 5 is equivalently performed by spring 27*a*.

A conventional prior art bow string trigger release of the type disclosed in U.S. Pat. No. 7,712,460 is designed to impart a recoil effect to the archers hand and is not designed for and was not disclosed for back tension release using the method of the instant invention. Thus, using the device and method of the instant invention an archer can select which release is desired or appropriate: (a) a trigger release; or (b) a back tension release. For example, when the archer is target shooting, a back tension release may be appropriate since target shooters often prefer the involuntary release of a back tension release. On the other hand when the archer is hunting, the archer may want a trigger release so that the arrow can be released by finger flexing at a moment selected by the hunter when the animal being hunted is most vulnerable.

The components of the instant invention can be made of any suitable material. It should be understood that the orientation of the coil spring biased plunger used in the instant invention can be attached to the wrist strap as shown, for example and without limitation thereto, as shown in FIG. 2. It should also be understood that incorporating a spring function into the wrist strap as shown in FIG. 3 and FIG. 4 is equivalent to a coil spring biased plunger.

CONCLUSION

While the instant invention has been described above according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains.

What is claimed is:

1. A bow release comprising a wrist strap, a first body and a second body, the first body comprising a bow string keeper and a trigger system for releasing a bow string held in the keeper, the second body comprising a coil spring biased plunger extending from the second body and attached to the first body, the second body attached to the wrist strap so that when the bow string of a bow is held by the bow string keeper while the bow is drawn by an archer having the wrist strap attached to the archers draw hand wrist, the archer can actuate the trigger of the trigger system to release the bow string from the bow string keeper, wherein the improvement comprises: the coil spring having an uncompressed length in the range of from one half inch to five inches and a spring rate in the range of from three pounds per inch to eighty pounds per inch, the coil spring compressed in the second body to a length in the range of from 0.15 inches to 2.5 inches.

2. The bow release of claim 1, wherein the coil spring has an uncompressed length in the range of from one inch to three inches and a spring rate in the range of from five pounds per inch to twenty five pounds per inch, the coil spring compressed to a length in the range of from 0.25 inches to 1.5 inches.

3. The bow release of claim 1, wherein the coil spring has an uncompressed length of about three inches and a spring rate of about twelve pounds per inch, the coil spring compressed to a length of about one inch.

4. The bow release of claim 1, wherein the coil spring has an uncompressed length of about three inches and a spring rate of about ten pounds per inch, the coil spring compressed to a length of about one inch.

5. The bow release of claim 1, wherein the coil spring has an uncompressed length of about three inches and a spring rate of about eight pounds per inch, the coil spring compressed to a length of about one inch.

6. The bow release of claim 1, wherein the coil spring has an uncompressed length of about three inches and a spring rate of about six pounds per inch, the coil spring compressed to a length of about one inch.

7. A method for an archer to release an arrow from a bow using the bow release of claim 1, comprising: (a) fixing the bow string of a bow to the bow string keeper while the bow is drawn by an archer having the wrist strap attached to the archers draw hand wrist while the archer draws the bow so that the archer can: (b) hold his/her trigger finger stationary adjacent the trigger of the trigger system as the bow is drawn to cause the first body to slide along his/her hand to contact the trigger with the stationary trigger finger to actuate the trigger to release an arrow from the bow as the bow as the bow is drawn as a back tension arrow release; or (c) hold his/her trigger finger adjacent the trigger of the trigger system to voluntarily actuate the trigger of the trigger system after the bow is drawn to release an arrow from the bow voluntarily.

8. The method of claim 7, wherein the coil spring of the improved bow release of claim 1 has an uncompressed length in the range of from one inch to three inches and a spring rate in the range of from five pounds per inch to twenty five pounds per inch, the coil spring compressed to a length in the range of from 0.25 inches to 1.5 inches.

9. The method of claim 7, wherein the coil spring of the improved bow release of claim 1 has an uncompressed length of about three inches and a spring rate of about twelve pounds per inch, the coil spring compressed to a length of about one inch.

10. The method of claim 7, wherein the coil spring of the improved bow release of claim 1 has an uncompressed length of about three inches and a spring rate of about ten pounds per inch, the coil spring compressed to a length of about one inch.

11. The method of claim 7, wherein the coil spring of the improved bow release of claim 1 has an uncompressed length of about three inches and a spring rate of about eight pounds per inch, the coil spring compressed to a length of about one inch.

12. The method of claim 7, wherein the coil spring of the improved bow release of claim 1 has an uncompressed length of about three inches and a spring rate of about six pounds per inch, the coil spring compressed to a length of about one inch.

* * * * *